US006050239A

United States Patent [19]

Fränkle et al.

[11] Patent Number: 6,050,239

[45] Date of Patent: Apr. 18, 2000

[54] CONTROL ARRANGEMENT FOR AN INTERNAL COMBUSTION ENGINE

[75] Inventors: Gerhard Fränkle, Remshalden; Michael Hoffmann, Weinstadt, both of Germany

[73] Assignee: DaimlerChrysler AG, Stuttgart, Germany

[21] Appl. No.: 09/135,373

[22] Filed: Aug. 17, 1998

[30] Foreign Application Priority Data

Aug. 18, 1997 [DE] Germany ..... 197 35 822

[51] Int. Cl.[7] ..... F02D 1/00

[52] U.S. Cl. ..... 123/320

[58] Field of Search ..... 123/320

[56] References Cited

U.S. PATENT DOCUMENTS

| | | | |
|---|---|---|---|
| 5,347,968 | 9/1994 | Johnson, Jr. | 123/320 |
| 5,386,809 | 2/1995 | Reesy et al. | 123/320 |
| 5,540,201 | 7/1996 | Feucht et al. | 123/320 |

*Primary Examiner*—John Kwon
*Attorney, Agent, or Firm*—Klaus J. Bach

[57] ABSTRACT

In a control arrangement for an internal combustion engine having a cylinderhead with a compressed air discharge valve and a compressed air system with a compressed air tank to which compressed air can be supplied from the engine cylinder by way of a connecting line, pressurized control fluid can be supplied to the compressed air discharge valve for opening the compressed air discharge valve for motor braking operation of the engine, and a bypass line including a control valve is provided by way of which the compressed air discharge valve can be directly controlled for supplying compressed air to the compressed air tank.

19 Claims, 5 Drawing Sheets

CONTROL ARRANGEMENT FOR AN INTERNAL COMBUSTION ENGINE

BACKGROUND OF THE INVENTION

The invention relates to a control arrangement for an internal combustion engine including pressure generating and pressure limiting elements and also control elements and further valves which are arranged in an engine cylinder head and of which at least one is connected to the electronic control arrangement and capable of establishing communication between a combustion chamber and the engine exhaust system.

MTZ, Motortechnishe Zeitschrift 56(1995) 7/8 discloses a control arrangement for an internal combustion engine whereby the engine braking power can be increased during engine braking operation. The control arrangement relates to a so-called decompression valve motorbrake (DVB) or, respectively, DVB-system. The DVB system controls the DVB valves arranged in the cylinder head of the internal combustion engine in such a way that they are no longer kept open during the whole compression stroke of the respective pistons but are opened only shortly before the piston reaches the top dead center position of the compression stroke, that is, compression TDC up to about 90° to 120° crank angle thereafter. In this way, a greater engine braking power can be achieved and compressed air can be discharged from the combustion chamber. The DVB system includes as pressure generating element, a radial piston pump and several pressure limiting elements such as a variable pressure control valve, an excess pressure valve and a return flow throttle. Furthermore, in the DVB system, the radial piston pump is connected, by way of a control line, with a central disc or respectively, a distribution unit by way of which the DVB valves of the various cylinders can be accurately controlled during operation of the internal combustion engine.

However, with the control arrangement described only motor braking operation of an internal combustion engine is possible.

U.S. Pat. No. 5,404,852 discloses an arrangement for controlling air compressed by a piston in a cylinder of an internal combustion engine by means of a control valve. The control valve is adjustable by an electronic control unit during the compression stroke of the piston during different positions before the top dead center position so as to be open or closed. The air withdrawn from the cylinder by way of the control valve is supplied to an exhaust gas pipe. Downstream of the control valve, there is a switch-over valve, by which the compressed air can be supplied selectively to a pressurized air line leading to a pressurized air storage container or to the exhaust pipe when the pressure of the air in the pressurized air storage container has reached a predetermined operating pressure.

In this arrangement, however, the internal combustion engine can be operated as an air compressor only during motor braking operation for generating compressed air for any pressurized air operated systems of a motor vehicle.

It is therefore the object of the present invention to provide an internal combustion engine with a control arrangement by which the internal combustion engine can provide pressurized air under any engine operating condition with little expense by appropriately controlling the engine.

SUMMARY OF THE INVENTION

In a control arrangement for an internal combustion engine having a cylinderhead with a compressed air discharge valve and a compressed air system with a compressed air tank to which compressed air can be supplied from the engine cylinder by way of a connecting line, pressurized control fluid can be supplied to the compressed air discharge valve for opening the compressed air discharge valve for motor braking operation of the engine, and a bypass line including a control valve is provided by way of which the compressed air discharge valve can be directly controlled for supplying compressed air to the compressed air tank.

By providing, in accordance with the invention, a bypass line with a pilot valve, in systems as they are basically known for increasing the motor braking power, communication between a combustion chamber and a pressurized air system of a motor vehicle can be established by controlling the valve in a particular way such that the pressurized air storage container can always be filled with compressed air from the combustion chambers of the cylinders. With the pilot valve, the control pressure for the valve can be modulated or changed, respectively.

In this way, one or several cylinders can be utilized as compressed air suppliers for the compressed air system of a motor vehicle wherein the discharge of the compressed air occuring otherwise is blocked.

With such an arrangement compressed air can be supplied to the compressed air system of a motor vehicle over the whole operating range of the internal combustion engine.

Also, during motor braking operation the cylinders utilized for supplying the compressed air can be controlled in the same manner.

Preferred embodiments of the invention will be described below on the basis of the accompanying drawings.

DESCRIPTION OF PREFERRED EMBODIMENT

Figure 1:
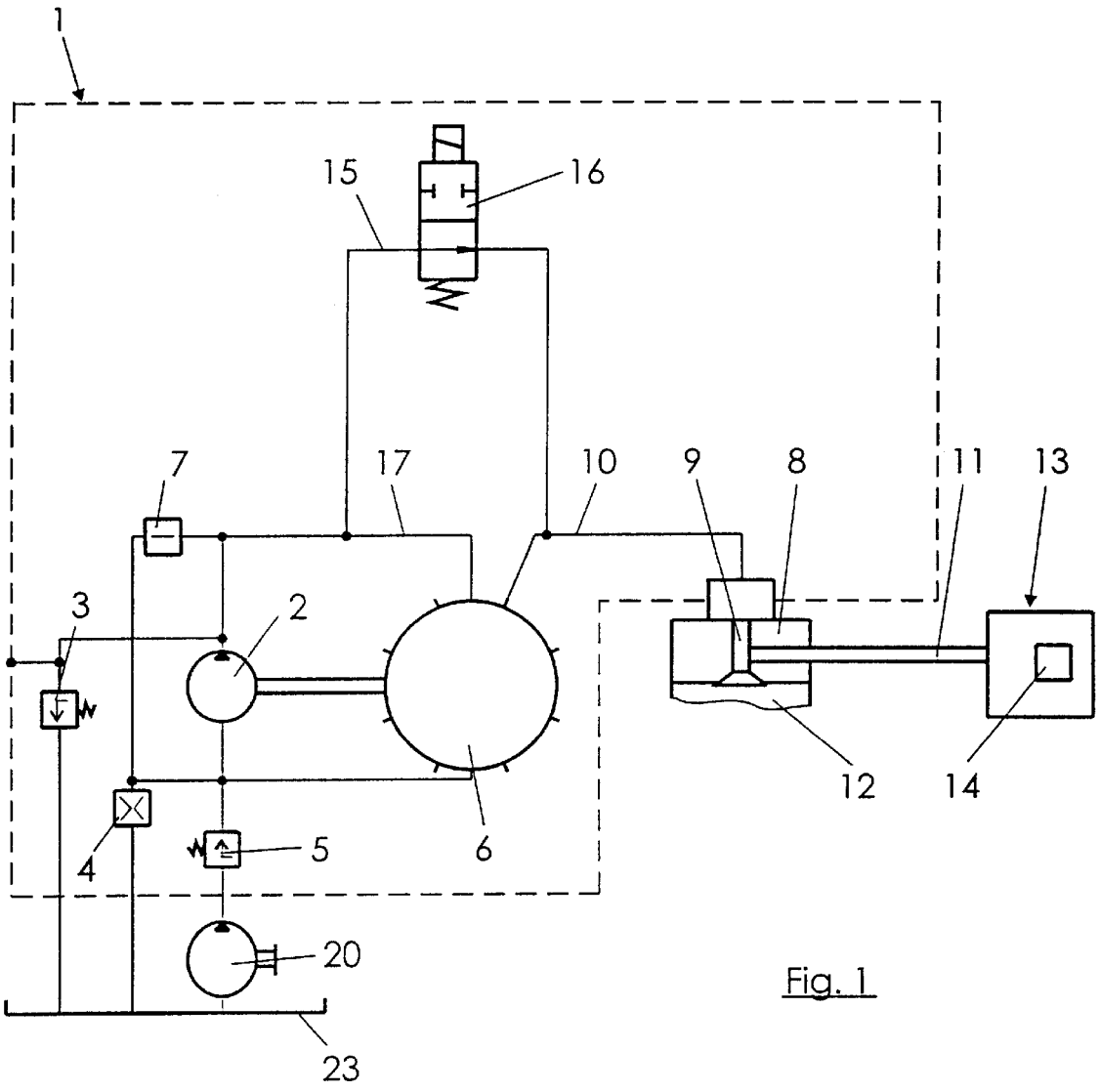
FIG. 1 shows a control arrangement for an internal combustion engine with a bypass line including a pilot valve.

FIG. 1 shows a control arrangement 1 of an internal combustion engine which is not shown. The control arrangement 1 includes in this embodiment a decompression valve motor braking system, that is, a DVB system wherein as pressure generating element a radial piston pump 2 and several pressure limiting elements as for example in this case, an excess pressure valve 3, a check valve 4 and a pressure limiting valve 5. In addition, the control arrangement 1 includes a control disc 6 which rotates at camshaft speed and which represents a control element and a variable pressure control valve 7, which serves as a control element.

The cylinder head 8 of the internal combustion engine includes a valve 9, which is in communication with the control arrangement 1 by way of a control line 10. The valve 9 is a DVB valve. The cylinder head may include only a single DVB valve or several DVB valves.

When the DVB valve 9 is open communication is established, by way of a connecting line 11, between a combustion chamber 12 of the internal combustion engine and a compressed air system 13, which includes a compressed air container 14 to which the air compressed in the combustion chamber 12 is supplied. Several DVB valves 9 may be provided in different combustion chambers 12 of the cylinder head 8, but only one DVB valve is shown in the drawings.

The control arrangement 1 includes a bypass line 15 with a 2/2 way control valve 16 arranged therein. The bypass line 15 extends between a control line 17 which interconnects the radial piston pump 2 and the control disc 6, and the control line 10 which interconnects the control disc 6 and the DVB valve 9. When the control valve 16 is open, the control pressure of the radial piston pump 2 is applied directly to the DVB valve 9.

For operating the DVB valve 9 by way of the control valve 16 when this valve is open, the control pressure for the DVB valve 9 can be modulated.

When the control valve 16 is closed, the DVB valve 9 is actuated by the control arrangement 1 by way of the control disc 6 in a well-known manner as are other DVB valves of the engine which are not shown in the drawings.

The pressure in the control arrangement 1 is maintained low by the variable control valve 7 so that the DVB valves of the operative engine cylinders (which are not shown) are not opened in the area of the top dead center positions of the pistons because of the high compression pressure in the combustion chambers. However, when the control valve 16 is open, fluid can be supplied to the DVB valve 9 with a pressure sufficient to operate the DVB valve 9 in the bottom dead center position of the respective piston.

During engine-driven operation with the engine operating, the variable pressure control valve 7 is set for a high press sure level. When the compressed air generating cylinder supplies compressed air to the compressed air container 14, the bypass line 15 is closed by closing the control valve 16 and the DVB valve 9 is opened. When the pistons of the remaining cylinders are in the area of the upper dead center positions, the control valve 16 is open, but there is not sufficient control pressure to open the DVB valves.

The DVB valves 9 of the cylinder head 8 are not opened since, with the timing of the fluid pressure to the DVB valve near the top dead center of the compression stroke when the pressure in the combustion chambers of the internal combustion engine is in the range of 40 to 160 bar, the control pressure of about 10 bar cannot open the DVB valves against the high pressure in the combustion chambers.

It is possible with an eventual switching off of the combustion in the pressure generating cylinder to replace the control valve 7 by a rapidly switchable valve.

Figure 2:
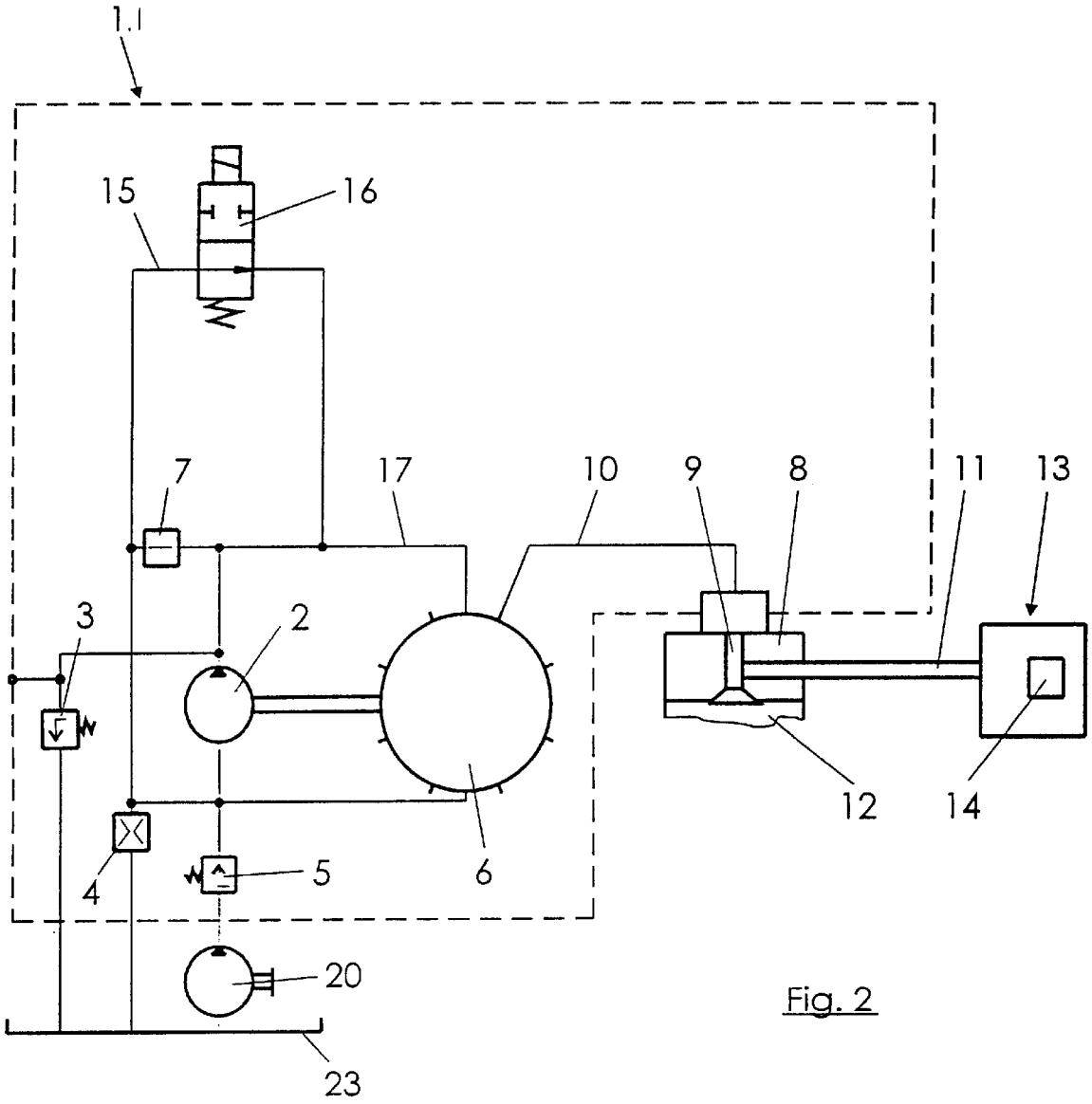
FIG. 2 shows a control arrangement according to FIG. 1, wherein the bypass line extends parallel to a pressure limiting element.

FIG. 2 shows a control arrangement 1, like that presented in FIG. 1. However, in contrast to FIG. 1, the bypass line 15 with control valve 16 is arranged in parallel with the variable pressure control valve 7 for use of the internal combustion engine as compressed air generator. This arrangement, like that of FIG. 1 requires essentially no changes at the radial piston pump 2, except for the provision of an additional connection.

Figure 3:
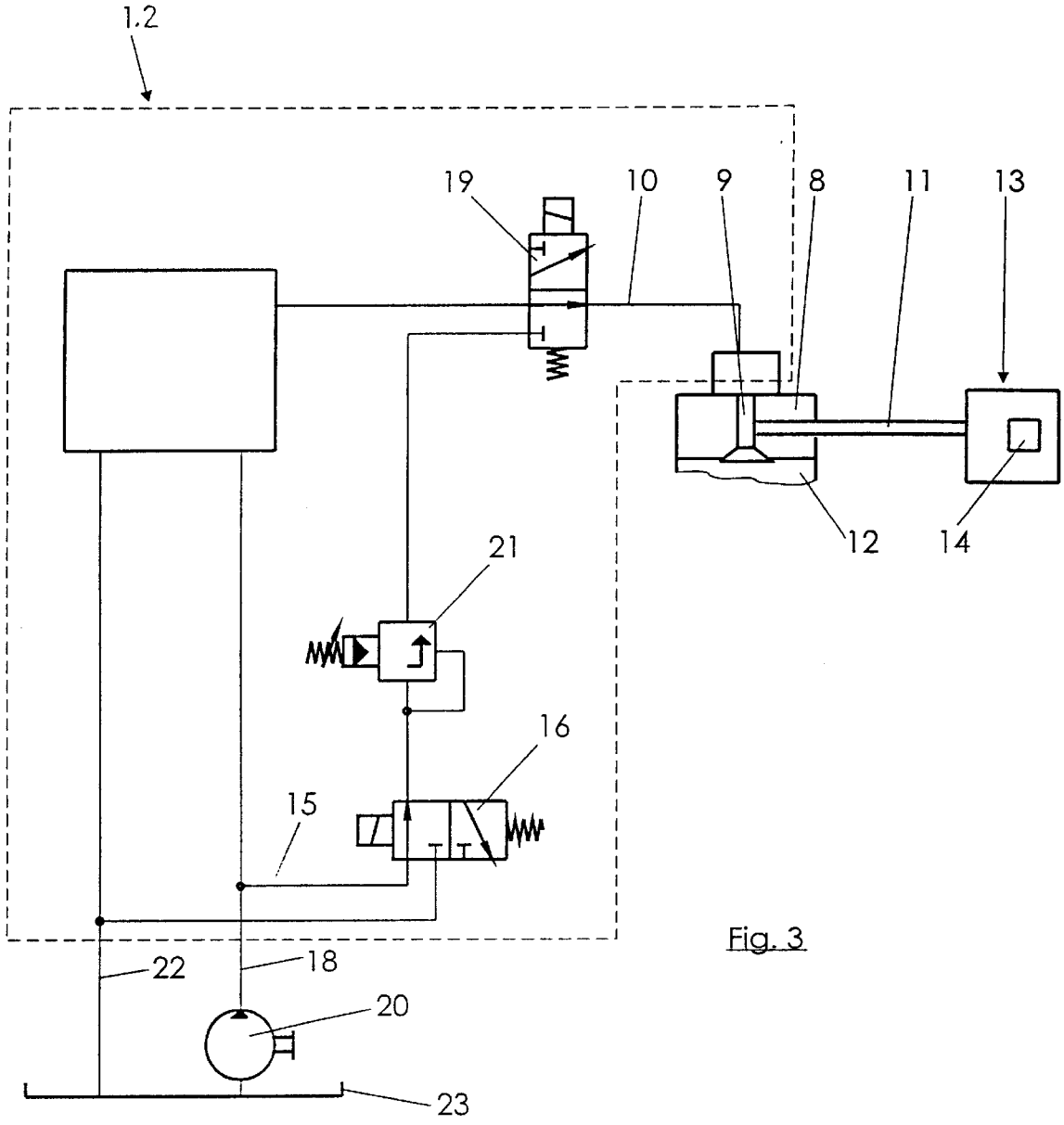
FIG. 3 shows schematically the control arrangement with a bypass line wherein a valve of a pressure generating unit is controllable by way of the bypass line with a control pressure.

FIG. 3 shows schematically a control arrangement 1.2 which includes essentially the same components as the control arrangement of FIG. 1, but not all the components are shwon. From a supply line 18, which enters the control arrangement 1, 2, a bypass line 15 extends to a pilot valve 19 which, depending on the switch position thereof, permits actuation of the DVB valve 9 by applying pressure thereto by the control arrangement 1, 2 or by an additional pressure generating device 20.

In the embodiment of FIG. 3, the pressure generating device 20 is the engine oil pump. In an embodiment not shwon in the drawing, a separate pumping device can be used in addition to the engine oil pump already present.

Between the engine oil pump 20 and the pilot valve 19, there are further provided the control valve 16 which has been described already in connection with FIG. 1 and which is in this case a 3/2 way control valve and a pressure limiting valve 21. It is the object of the pressure limiting valve 21 to modulate the control pressure for the DVB valve 9 depending on engine load and engine speed in such a way that the DVB valve 9 automatically closes at the correct point in time in the top dead center area of the piston. From the control valve 16, a return line 27 leads back to the oil reservoir 23 from which the supply line 18 originates.

The radial piston pump 2 of the control arrangement 1 is capable of generating pressures up to 120 bar and, in this way, opens the valves of the various cylinders when the respective pistons are in the vicinity of the upper dead center position by way of the control disc 6. By utilizing the control arrangement 1 shown in FIGS. 1 to 3, the extraction of compressed air from the combustion chambers 12 can be modified for the various engine operating states.

The DVB valve 9 is so controlled that, during compression, compressed air is released into an exhaust system, which is not shown, in order to reduce or eliminate re-expansion. Since the connecting line 11 leads from the DVB valve 9 to the compressed air system of the motor vehicle, compressed air can be supplied during engine braking operation from the combustion chamber 12 to the compressed air system. Depending on the state of the compressed air system 13, the pressure may be between 6 and 12 bar. This means that a cylinder of the internal combustion engine can be used for supplying compressed air to the compressed air system 13 from the DVB valve by way of the connecting line 11.

During engine driven operation while combustion still occurs in the engine, it is normally not possible to activate the control arrangement 1, since it is not possible to inject fuel into the combustion chamber 12 and to release the air compressed in the combustion chamber 12 by way of the DVB valve 9.

In order to allow for use of a cylinder of the internal combustion engine for supplying compressed air to the compressed air system 13 during engine driven operation or during normal engine driving operation, the bypass line 15 for the control line 10 leading to the compressed air generating cylinder is provided and the engine oil pump 20 is disposed in communication with the control arrangement 1.

By energization of the control valve 16, the control pressure can be supplied to the DVB valve 9 of the compressed air generating cylinder such that the DVB valve can be opened in the area of the lower dead center position of the piston whereby compressed air can be supplied to the compressed air system 3.

The control valve 16 can be energized, for example, electrically if the control valve is a magnetically operated valve. The same applies to the other control valves used in the control arrangement 1.

Since, during compression, the pressure in the combustion chamber is rapidly increasing, but the pressure on the side of the DVB valve 9 remote from the combustion chamber 12 remains essentially unchanged, the DVB valve 9 will automatically be closed by the pressure difference before fuel injection into the combustion chamber begins.

At the same time, the injection volume is reduced in accordance with the extracted air mass. As a result, the control arrangement is able to control the DVB valve 9 in such a way that compressed air can be extracted from the combustion chamber 12 even during normal engine operation.

In order to be able to generate the necessary control pressures for all engine loads and engine speeds, the control pressure can be increased to the required level depending on the charge air pressure of the internal combustion engine and/or depending on engine load and engine speed. In this way, it can be insured that the DVB valve 9 is opened and automatically closes or is controlled to close before fuel injection into the combustion chamber 12 is initiated.

During the procedure, the pressure of the compressed air in the combustion chamber 12 is effective on the DVB valve 9 against the control pressure which can be modulated. When the piston is in the lower dead center area, no pressure is present in the combustion chamber 12. During the compression stroke, the air or gas in the combustion chamber 12 is compressed and the air or gas pressure against the DVB valve 9 increases. Depending on the value of the counter pressure, the valve spring force and on the control pressure, a force equilibrium is reached before the piston reaches the top dead center area where the force generated by the air or gas pressure exceeds the force generated by the control pressure and the DVB valve 9 closes.

The cylinder gas pressure which is present in the combustion chamber varies depending on the speed of the internal combustion engine and on the engine load conditions. Consequently, the point in time at which the DVB valve 9 closes depends on the load condition and the speed of the engine. CoAs a result, the closing point of the DVB valve 9 can be controlled depending on engine speed and the load conditions by modulation of the control pressure. The control pressure is adjustable by the pressure limiting valve 21.

Figure 4:
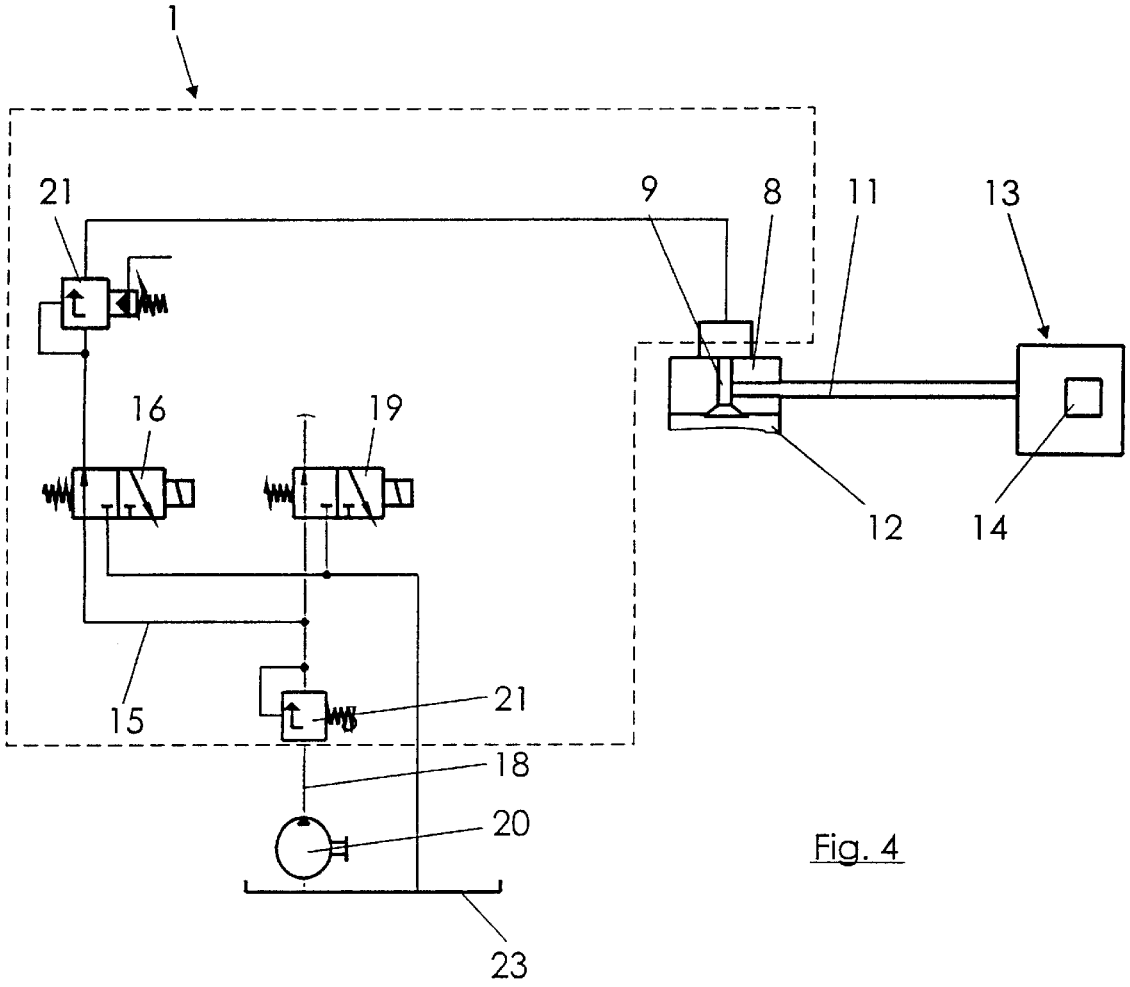
FIG. 4 shows a control arrangement for a constant throttling system.

FIG. 4 shows a constant throttle system which is known as such in an internal combustion engine. In order to be able to generate compressed air by the internal combustion engine using the control arrangement 1.3 also with a constant throttle system, the valve 9 which, in this case, is a constant throttle valve 9 is operated by the engine oil pressure.

During constant throttle operation, the constant throttle valves 9 of an internal combustion engine are held open constantly and, at the beginning of motor braking operation are opened in the bottom dead center position of the piston shortly before the beginning of the compression stroke.

The engine oil pressure is modulated corresponding to the charge pressure and/or the engine speed and the engine load in such a way that the constant throttle valves 9 of the cylinders used for the generation of the compression air are kept constantly open during motor braking operation.

During power operation of the internal combustion engine, the control pressure is so modulated that the constant throttle valve 9 opens shortly after the bottom dead center position of the piston and automatically closes depending on the level of the control pressure provided but not later than at the begin of fuel injection.

From the engine oil pump 20, a supply line 18 extends to a pilot valve 19 which is a 3/2 way valve and by which pressurized control fluid is supplied to the rest of the valves of the internal combustion engine.

From the supply line 18, the bypass line 15 extends to the constant throttle valve 9 to which a control pressure from the engine oil pump 20 can be applied.

The bypass line 15 includes a pressure limiting valve 21 and a control valve 16 which is a 3/2 way valve, the control valve 16 being adapted to initiate or discontinue motor braking operation. Like in the embodiments of FIGS. 1 to 3, the pressure limit valve 21 is used for the modulation of the fluid pressure applied to the constant throttle valve 9.

With this arrangement, the constant throttle valve 9 can be controlled independently of the other valves for supplying compressed air to the compressed air system 3.

Figure 5:
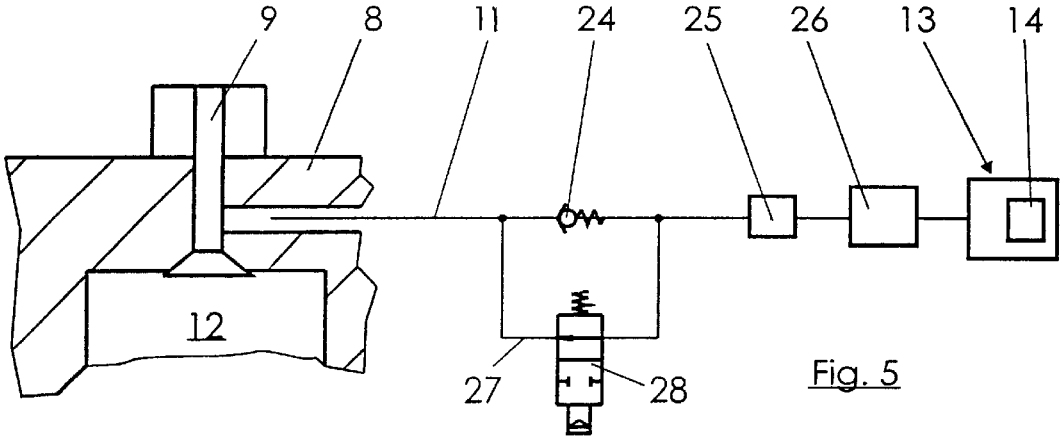
FIG. 5 shows an interconnection path between the combustion chamber of a pressure generating cylinder and a compressed air container.

As shown in FIG. 5, the connecting line 11 between the combustion chamber 12 and the compressed air container 14 includes a check valve 24. Furthermore, a heat exchanger 25 is arranged in the connecting line 11 between the compressed air container 14 and the check valve 24 for cooling the compressed air. The heat exchanger 25 can be provided as desired and may be integrated into the connecting line 11 as a separate unit.

In another embodiment, which is not shown, the heat exchanger 25 may be formed integrally with the cylinder head 8 or may be integrated into the cylinder head 8.

The connecting line 11 may also include a dryer 26 with an excess pressure valve having a pressure controller and a discharge nozzle (both not shown). In his way, moisture can be removed from the compressed air before it is supplied to the compressed air container 14.

When the pressure in the compressed air container 14 reaches an upper limit, an excess pressure valve which is disposed in the connecting line 11, but is not shown, opens to relieve pressure.

In order to prevent oil induction from the engine crankcase (which is not shown) when a vacuum is generated in the combustion chamber, a bypass line 27 with a control valve 28 is provided in the connecting line 11 in a parallel arrangement to the check valve 24. In this way, compressed air can be returned from the compressed air container 14 to the combustion chamber 12 to counteract a vacuum in the combustion chamber and to prevent the induction of oil from the crankcase into the combustion chamber.

By appropriate pressure modulation or, respectively, by changing the opening duration or by changing the closing time of the valve 9, the air volume withdrawn from the compressed air container can be controlled so that only sufficient air is withdrawn as is needed to prevent the formation of a vacuum to prevent oil induction. This means that, because of a shortened opening period of the valve 9 which is the result of an earlier closing time, a residual gas volume remains in the combustion chamber 12 whereby, during the expansion of the air following the compression phase, no vacuum develops in the cylinder in the bottom dead center area of the piston movement.

Oil induction into the cylinder can also be prevented by arranging a valve (not shown) in the connecting line 11 through which ambient air can enter, for example at the intake pipe, into the connecting line 11 and into the combustion chamber 12 for pressure compensation.

Figure 6:
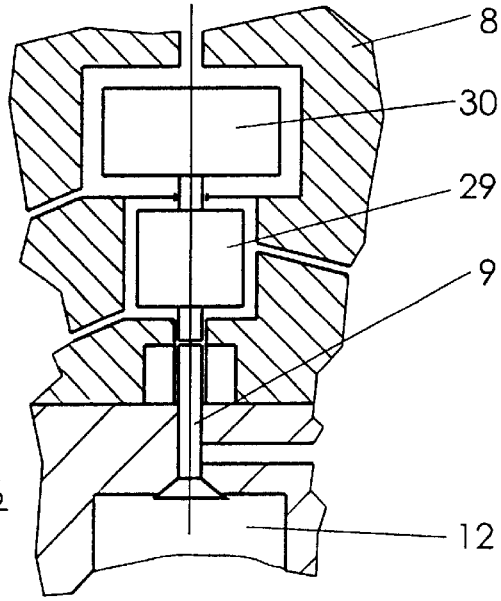
FIG. 6 shows a transmission element, that is, a stepped piston which is disposed on the control piston of a valve.

FIG. 6 shows the valve 9 which may be in the form of a DVB valve or a constant throttle valve. At the end remote from the combustion chamber 12, the valve 9 includes a control piston 29. Since the geometry or rather the cross-sectional area of the control piston 29 is too small for an actuation of the valve 9 by the engine oil pressure, especially for opening the valve 9 at the beginning of the compression stroke, a second piston 30 is arranged above the control piston 29. In this way, the force generated by control pressure transmitted from the oil pump 20 to the valve 9 is increased to a level sufficient for operating the valve 9.

Because of the arrangement of the control pistons 29, 30, the valves 9 remain open when subjected to the control pressure.

Figure 7:
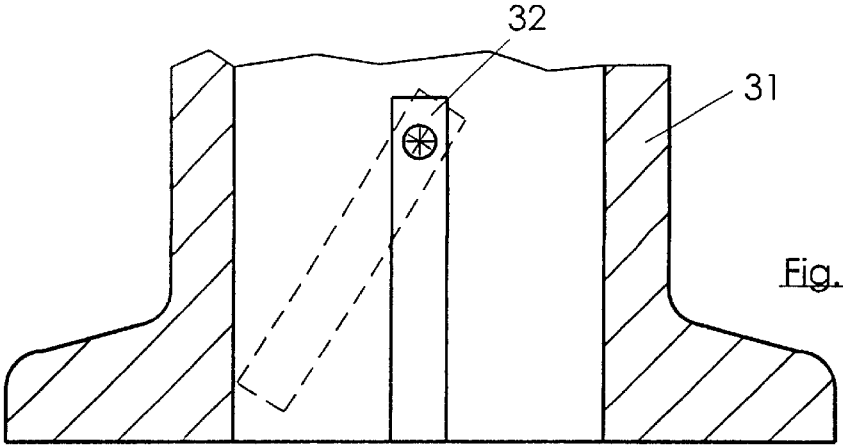
FIG. 7 is a cross-sectional view of a portion of a two-passage turbine housing of an exhaust gas turbocharger of an internal combustion engine.

FIG. 7 shows a portion of a double inlet passage turbine housing 31 of an exhaust gas turbocharger with a brake valve flap 32.

To compensate for the smaller motorbrake power during constant throttle operation, the exhaust gas flow of the engine is not conducted as usual through two inlet flow passages to the turbine of the turbocharger, but only by way of one of them. Because of the greater gas flow, the engine braking power is increased and the brake flap 32 can be opened in the higher engine speed range whereby the charge air pressure of the turbocharger is increased. With the increased charger air pressure, also the compressed air mass flow is increased.

In another embodiment which is not shown, the valve 9 may be operated by a hydraulic control system while the remaining valves of the internal combustion engine are controlled by a pneumatic control system.

The interconnection between the combustion chamber 12 of the compressed air generating cylinders and the exhaust gas system is interrupted or blocked for the compressed air while air is supplied to the compressed air container 12 by a valve means which is not shown.

When, at the beginning of the compression stroke and during engine driven operation, the DVB valve is additionally controlled up to the top dead center position of the compression stroke, a plug-in pump DVB system of a common rail internal combustion engine can be used for the control of the compressed air generating cylinder.

In such an arrangement, the plug-in DVB system controls with a plug-in pump and double cams two cylinders displaced by 360° by metered volume admission in the correct time window. This system can be expanded by a stepped cam each for additional charging and consequently for an increased motor braking power.

In a different embodiment of the internal combustion engine, which is not shown in the drawings, an exhaust gas recirculation system may be utilized.

In a combination using exhaust gas recirculation to the cylinders and a cylinder for generating compressed air for the compressed air system, it is advantageous if a valve or flap is so arranged in the intake duct that no exhaust gas can enter this cylinder while it is used as an air compressor. In this way, it is insured that contaminants contained in the exhaust gas do not enter the compressed air system.

In still another embodiment (not shown in the drawings), the compressed air generating cylinder is not used for power generation during engine driving operation. In this case, the load of the other cylinders is correspondingly increased during vehicle operation so that no great power loss can be noticed. However, this procedure can be followed only until the operating cylinders are subjected to full load. If, under a particular operating condition, more power output of the engine is needed than can be generated by the operating cylinders, the cylinder used for generating compressed air can further be used for this purpose or it can be switched back for generating power if full power output of the engine is more desirable. Otherwise, the engine operates with somewhat reduced power output.

What is claimed is:

1. A control arrangement for an internal combustion engine having a cylinder head, a compressed air discharge valve arranged in said cylinder head, a compressed air system with a compressed air tank, a connecting line extending between said compressed air discharge valve and said compressed air tank for supplying compressed air to said compressed air tank from said compressed air discharge valve, at least one pressurized control fluid generating element, a control element for a controlled application of said pressurized control fluid to said compressed air discharge valve for operating said compressed air discharge valve during motor braking operation of said engine such that compressed air is discharged from a combustion chamber of said internal combustion engine, and a by-pass line including a control valve for controlling the supply of control fluid to said compressed air discharge valve for opening said compressed air discharge valve under the control of said control valve.

2. A control arrangement according to claim 1, wherein said by-pass line extends between a first control line which leads from said pressurized control fluid generating element to said control element and a second control line which extends between said control element and said compressed air discharge valve.

3. A control arrangement according to claim 1, wherein said by-pass line extends in parallel with a pressure control element for controlling the pressure of said pressurized control fluid when said control valve is closed and the pressure of said pressurized control fluid is released when said control valve is opened.

4. A control arrangement according to claim 1, wherein said by-pass line extends in parallel with a pressurized control fluid supply line to a pilot valve for controlling said compressed air discharge valve selectively by pressurized control fluid from either one of said pressurized control fluid supply line and said bypass line.

5. A control arrangement according to claim 1, wherein said compressed air discharge valve is a decompression valve motor brake valve (DVB valve).

6. A control arrangement according to claim 4, wherein said compressed air discharge valve is a constant throttle valve.

7. A control arrangement according to claim 6, wherein said by-pass line extends between a pressurized control fluid supply line and said constant throttle valve.

8. A control arrangement according to claim 1, wherein said compressed air discharge valve includes a control piston with two pistons arranged in tandem for generating a sufficient force level to operate said compressed air discharge valve.

9. A control arrangement according to claim 1, wherein said connecting line extending from said compressed air discharge valve to said compressed air container includes a check valve.

10. A control arrangement according to claim 1, wherein said connecting line extending between said compressed air discharge valve and said compressed air container includes a heat exchanger, and a dryer with an excess pressure discharge valve, a pressure controller and discharge nozzle.

11. A control arrangement according to claim 10, wherein said connecting line include a check valve and a by-pass line by-passing said check valve and including a control valve for permitting controlled return flow of said compressed air.

12. A control arrangement according to claim 1, wherein said by-pass line includes a pressure limiting valve.

13. A control arrangement according to claim 1, wherein said pressure generating element is an engine oil pump.

14. A control arrangement according to claim 1, wherein the part of said control arrangement for operating said compressed air discharge valve is a hydraulic system and the part for operating the other valves is a pneumatic system.

15. A control arrangement according to claim 1, wherein a discharge line from a cylinder generating said compressed air to an engine exhaust system is closed while compressed air is supplied from said cylinder to said compressed air container.

16. A control arrangement according to claim 15, wherein said compressed air discharge valve is part of a decompression valve brake system (DVB system).

17. A control arrangement according to claim 1, wherein said internal combustion engine includes an exhaust gas recirculation system and in the air intake duct of an air compressing cylinder a flow control valve is provided which is adapted to prevent exhaust gas recirculation to said air compressing cylinder.

18. A control arrangement according to claim 1, wherein, during power operation of said engine, compressed air is supplied by one of the engine cylinders to which no fuel is supplied.

19. A control arrangement according to claim 18, wherein, during full engine power operation, said one engine cylinder is returned to power output operation by resuming fuel supply to said one engine cylinder.

* * * * *